US008580351B2

(12) United States Patent
Haje et al.

(10) Patent No.: US 8,580,351 B2
(45) Date of Patent: Nov. 12, 2013

(54) HYDROPHOBIC COATING OF CONDENSERS IN THE FITTED STATE

(75) Inventors: Detlef Haje, Görlitz (DE); Tobias Jockenhoevel, Nürnberg (DE); Heinrich Zeininger, Obermichelbach (DE)

(73) Assignee: Siemens Aktiengesellschaft, München (DE)

( * ) Notice: Subject to any disclaimer, the term of this patent is extended or adjusted under 35 U.S.C. 154(b) by 1010 days.

(21) Appl. No.: 12/612,772

(22) Filed: Nov. 5, 2009

(65) Prior Publication Data

US 2010/0115950 A1 May 13, 2010

(30) Foreign Application Priority Data

Nov. 10, 2008 (DE) ..... 10 2008 056 621

(51) Int. Cl.
*B05D 1/04* (2006.01)
*B05D 1/02* (2006.01)

(52) U.S. Cl.
USPC ..... 427/486; 427/475; 427/427.3; 427/427.5

(58) Field of Classification Search
USPC ..... 427/475, 486, 427.3, 427.5
See application file for complete search history.

(56) References Cited

U.S. PATENT DOCUMENTS

| | | | | |
|---|---|---|---|---|
| 3,899,366 | A | 8/1975 | Tajkowski | |
| 4,524,607 | A * | 6/1985 | Pelletier et al. | 73/40.5 R |
| 6,058,718 | A * | 5/2000 | Forsberg et al. | 62/125 |
| 6,743,467 | B1 * | 6/2004 | Jones et al. | 427/180 |
| 2007/0251091 | A1 * | 11/2007 | Minami et al. | 29/890.054 |
| 2009/0004379 | A1 * | 1/2009 | Deng et al. | 427/203 |

FOREIGN PATENT DOCUMENTS

| | | | |
|---|---|---|---|
| DE | 833049 | | 3/1952 |
| DE | 102007008038 | A1 | 9/2008 |
| DE | 10 2007 017 518 | A1 | 10/2008 |
| DE | 102007015450 | A1 | 10/2008 |
| GB | 2428604 | A | 2/2007 |
| WO | 0156711 | A1 | 8/2001 |

* cited by examiner

*Primary Examiner* — Frederick Parker

(57) ABSTRACT

A method for producing a condenser for a thermal power plant is provided. First, the production method includes fitting a condenser tube in a carrier for a condenser tube bundle of the condenser. Then, the fitted condenser tube is coated with a hydrophobic coating. Coating the fitted condenser tube includes positioning a spray mechanism on the carrier, spraying on the hydrophobic coating using a spray mechanism, and moving the spray mechanism during spraying at a uniform rate. In another aspect, a device is provided. Also, a condenser is provided in an aspect.

11 Claims, 2 Drawing Sheets

HYDROPHOBIC COATING OF CONDENSERS IN THE FITTED STATE

CROSS REFERENCE TO RELATED APPLICATIONS

This application claims priority of German application No. 10 2008 056 621.7 DE filed Nov. 10, 2008, which is incorporated by reference herein in its entirety.

FIELD OF INVENTION

The present invention relates to a method for producing a condenser for a thermal power plant and to the condenser for the thermal power plant. The invention also relates to a device for coating a fitted condenser tube with a hydrophobic coating.

BACKGROUND OF THE INVENTION

In a steam turbine total enthalpy of steam is utilized to convert thermal energy, for example from atomic energy, coal or other energy carriers, into mechanical energy. In the process steam is provided from a liquid working fluid, such as water, in a steam generator and fed to a turbine. A difference in the enthalpy of the steam can be used in this turbine to generate mechanical energy. A condenser or steam condenser is arranged downstream of the turbine to provide isobaric condensation of the steam.

Surface condensers for steam turbine plant are known as steam condensation, the surface condensers comprising a large number of uncoated condenser tubes. Film condensation conventionally takes place on the condenser tubes, which are filled with a cooling working fluid, so the liquid steam transforms into a liquid aggregation state.

The condenser tubes can, moreover, be hydrophobically coated to provide a purposeful transition from film condensation to dropwise condensation. An increase in heat transfer can be achieved by means of dropwise condensation, whereby an improvement in the heat transfer coefficient of about 20% occurs. This in turn leads to an improvement in the efficiency of the condenser (smaller temperature difference) or to a reduction in costs and installation space with the same temperature difference.

DESCRIPTION OF THE INVENTION

It is the object of the invention to provide a condenser with improved efficiency.

The object is achieved with the features of the independent claims, in particular by means of a method for producing a condenser for a thermal power plant, a device for coating a fitted condenser tube with a hydrophobic coating and a condenser for a thermal power plant.

According to a first exemplary embodiment of the present invention a method for producing a condenser for a thermal power plant is described. A condenser tube is fitted in a carrier for a condenser tube bundle of the condenser. The fitted condenser tube is coated with a hydrophobic coating.

According to a further exemplary embodiment a device for coating a fitted condenser tube with a hydrophobic coating is created according to the above-described production method. The device comprises a spray head for coating the fitted condenser tube with the hydrophobic coating.

According to a further exemplary embodiment of the present invention a condenser for a thermal power plant is created. The condenser is produced using the above-described method. The condenser comprises a carrier with a fitted condenser tube, the fitted condenser tube having a hydrophobic coating.

The term "condenser tube bundle" can be taken to mean one condenser tube or a large number of condenser tubes which are mounted in a carrier (condenser tube carrier) at a specific spacing from one another, and form a condenser tube unit or the condenser tube bundle. Steam that is to be cooled can, for example, strike a condenser tube bundle, so the steam can flow past the individual condenser tubes via the condenser tube bundle. The carrier can also be constructed to space apart the individual condenser tubes at a defined spacing, so the steam can flow between the condenser tubes and be cooled by them. The carrier can be made, for example, from tube bottoms and supporting walls which have holes and receiving units to which the individual condenser tubes may be secured.

The term "hydrophobic" or "hydrophobic coating" can be taken to mean a surface which is water-repellant or on which dropwise condensation can take place. Furthermore, the term "hydrophobic coating" can hereinafter also be taken to mean a coating which has an oleophobic effect, i.e. which has an oil-repelling effect, A hydrophobic coating has a contact angle in the case of liquid droplets of greater than 90°. The contact angle can be up to 130° in the case of hydrophobic coatings. With structured surfaces a superhydrophobic effect (for example lotus effect) can be achieved with a contact angle of greater than 130° or greater than 160° (degrees). The contact angle defines an angle between a surface of a coating and a vector running tangentially on a liquid drop at the contact point of the drop with a component surface. In the case of a contact angle of greater than 90° and a with a drop of water a drop shape is formed on a surface, so dropwise condensation can be provided with a contact angle of greater than 90°.

Condenser tubes are conventionally coated before being fitted in the carrier and following coating are inserted in the carrier for the condenser tube bundle. Insertion or fitting of the condenser tubes that have already been coated can damage the hydrophobic coating however. Hydrophobic coatings have sensitive properties, so there is low abrasion resistance and the risk of the hydrophobic coatings on the condenser tubes being damaged during fitting is high. In this case a condenser tube coating with superhydrophobic layers (for example coating with the "lotus effect") can be particularly desirable, wherein such superhydrophobic layers are particularly sensitive in relation to mechanical stress, so subsequent fitting of the coated condenser tubes leads to a high risk of coating damage. Furthermore, besides insertion of the condenser tubes, the coating can also be damaged by the method used to fasten the condenser tubes to the carrier of the condenser tube bundle. Condenser tubes are, for example, welded to the carrier, whereby damage can occur to the hydrophobic coating. Furthermore high maintenance requirements are required to retrofit hydrophobically coated condenser tubes by means of tube replacement, so maintenance and installation times are long.

By means of the claimed production method a hydrophobic coating is applied to a fitted condenser tube. In other words, the hydrophobic coating is applied to a condenser tube that is already fastened in a condenser tube bundle. It is therefore possible to treat a condenser in a single coating operation as it is being produced, so the condenser tubes of the condenser can be provided with the hydrophobic coating in a single step, whereby the time expended on production can be reduced. During subsequent maintenance procedures of the condensers a hydrophobic coating can, moreover, be renewed without the individual condenser tubes having to be dismantled.

With the claimed production method of the condenser it is also possible for only some of the condenser tubes to be coated in the fitted state and for the other condenser tubes to remain uncoated. By way of example, the outer tubes respectively of a condenser tube bundle contribute most to the condensation output of the condenser. Therefore the advantages of the invention can already be attained by firstly fitting the outer condenser tubes in the carrier of the condenser tube bundle and coating them with the hydrophobic coating in the fitted state. At least the outer condenser tubes of the condenser tube bundle have a high-quality hydrophobic coating therefore. As these outer condenser tubes, located at the edge of the carrier, provide the greatest condensation output of the condenser, it is particularly advantageous to provide a high-quality hydrophobic coating in the case of precisely these condenser tubes. It is therefore possible to achieve a higher condenser condensation output without dismantling the condenser tubes.

There is also an improved servicing option and a better retrofit option (servicing or retrofitting option). This can be an important factor for a power plant operator in particular as a short steam turbine or condenser downtime leads to a significant improvement in efficiency without substantial assembly work. An attractive business area in the servicing sector can be provided for the manufacturer of the steam turbine moreover.

A choice of coating can also be made due to application of the condenser tube coating in the fitted state without assembly issues having to be considered. It is precisely in the case of coated condenser tubes that, for example, the fact that the coating comes into contact with fastening means on the carrier, which leads to the coating wearing off, has to be considered. A complex insertion process of the condenser tubes through a series of fastening holes has previously potentially ruled out use of the mechanically less stable, structured hydrophobic coatings. Subsequent coating of the fitted condenser tubes by means of the claimed production method can therefore make it possible to apply hydrophobic coatings to the condenser tubes, so a further improvement in condensation properties can be achieved.

Coating of the fitted condenser tube with the hydrophobic coating also comprises at least one positioning of a spray mechanism on the carrier or relative to the carrier. The hydrophobic coating is then sprayed on by means of the spray mechanism in order to coat the fitted condenser tube with the hydrophobic coating. A particularly thin and uniform application of the hydrophobic coating to the fitted condenser tube can be provided by means of spray coating owing to a very fine spray dust of the hydrophobic coating compound.

Furthermore, the step of coating the fitted condenser tube with the hydrophobic coating comprises moving the spray mechanism during spraying at a uniform feed rate along a direction of extension of the fitted condenser tube. Uniform spraying or coating of the fitted condenser tube can therefore automatically be provided. It is precisely with manual application of a coating that irregularities can occur in the spray application of the hydrophobic coating as a result of an erratic manual feed rate, so different layer thicknesses are achieved on the condenser tube. By using the spray mechanism, which provides a uniform feed rate, a predefined and uniform layer thickness of the hydrophobic coating can be provided meaning predefined and improved condenser effects of the condenser tube can be attained. Furthermore, repeated movement at the uniform feed rate means a large number of hydrophobic coating layers can be applied. Therefore a hydrophobic coating can consist, for example, of 10, 12 or more undercoatings. A uniform feed rate orthogonal to the direction of extension of the fitted condenser tube can also be provided in addition to a uniform feed rate along a direction of extension of the fitted condenser.

According to a further exemplary embodiment of the method the condenser is mounted on the thermal power plant during coating and has already been in operation before the coating process, for example. The power plant operator can therefore carry out a touch-up or apply the hydrophobic coating to the fitted condenser tube without emptying the condenser tubes and with minimal effort therefore. Dismantling of the condenser tube, and therewith an interruption in the operation of the condenser, can be avoided.

According to a further exemplary embodiment the fitted condenser tube is coated with the hydrophobic coating by means of a spread coating. A condenser tube can be coated easily and quickly with the hydrophobic coating by means of spread coating. Brush devices, for example, can be used in spread coating.

According to a further exemplary embodiment the spray mechanism comprises a spray head, wherein coating of the fitted condenser tube with the hydrophobic coating also comprises introducing the spray head into the carrier to coat the fitted condenser tube with the hydrophobic coating.

The term "introduce" the spray head into the carrier can be used to describe a possibility of coating the inside of a condenser tube bundle in addition to spraying the outer condenser tubes of the condenser tube bundle. In this case the spray head can be introduced into the carrier in such a way that the spray head can be led between the condenser tube spacings and can therefore coat inner condenser tubes which, for example, have no direct connection with the surroundings of the condenser tube bundle. Even condenser tubes that are fitted so as to be hidden can therefore be coated with the hydrophobic coating in the fitted state, so dismantling of these inner tubes may not be necessary either. The spray mechanism can, for example, be positioned on or in the carrier of the condenser tube bundle and provide a spray application of the coating by means of the uniform feed rate along the condenser tubes.

According to a further exemplary embodiment the step of coating the fitted condenser tube with the hydrophobic coating also comprises coating the fitted condenser tube by means of electrospray coating. The standard of coating for example can be improved using electrostatic effects by means of electrospray coating. With the method of electrospray coating the spray of the hydrophobic coating can be electrostatically charged during application, for example at 35 kV (kilovolts), 40 kV or 50 kV, and sprayed onto grounded condenser tubes. The condenser tubes are connected to a ground potential in this case. By way of example the carrier of the condenser tube bundle can be a metallic conductor and can therefore be used as an electrically conductive structural component. The condenser tubes themselves, or the electrically conductive structural components, can be provided with a connection to ground (grounding, ground potential). The hydrophobic coating can be electrostatically charged, for example with a voltage source. Electrospray coating therefore provides the advantage that the hydrophobic coating is uniformly distributed, for example in the case of a spray application, and the loss of material in the hydrophobic coating can, moreover, be reduced. Applying the hydrophobic coating to the condenser tubes by means of electrospray coating also makes all-round coating of the condenser tubes possible. If, for example, the spray head is located on one side of the condenser tube the spray can still be deposited on the opposing side of the condenser tubes owing to the electrostatic charge, so a hydrophobic coating can also be provided on opposing points of the condenser tubes. A predefined, thin and uniform hydrophobic coating can be provided on the condenser tubes using electrospray coating by suitably selecting the metering of the hydrophobic coating and by suitably selecting the feed rate or applied static voltage, so predefined hydrophobic properties can be provided on any of the condenser tubes.

According to a further exemplary embodiment the hydrophobic coating is crosslinked on the fitted condenser tube by means of UV curing, dual cure and/or thermal curing.

The term "crosslinking" can be taken to mean a connection of the coating with a surface of the condenser tubes. The term "crosslinking" can mean that the coating is permanently joined to the surface of the condenser tubes. This is made possible for example in that the molecules of the coating join with the atoms/molecules of the condenser tube surface or that molecules of the coating mesh with cavities in the surface of the condenser tube and thus create a permanent join.

With UV curing an ultraviolet (UV) light is radiated in the direction of the coating by means of a UV radiator, so crosslinking of the coating occurs as a result of excitation of the molecules in the coating and owing to the resulting temperature.

A further technology for crosslinking by means of UV curing is the dual cure method in which curing is firstly initiated by UV radiation and then the hydrophobic coating is completely cured at ambient temperature, and this results in crosslinking.

The term "thermal curing" is also used to describe crosslinking by curing due to the application of thermal energy. The temperature ranges in thermal curing can lie between 50° C. and 100° C. or in the range between 100° C. and 200° C. or even between 100° and 250° C. The thermal energy can, for example, be applied by means of radiant heaters, heating coils, resistance heating or hot-air blowers. The thermal energy for curing can also be achieved by means of a heating fluid in the condenser tubes, so, potentially, no additional thermal energy sources are required. On the other hand, the working fluid in the condenser tubes can be drained to avoid a disadvantageous thermal capacity of a fluid-filled tube.

According to a further exemplary embodiment a sol gel method is used in the step of coating the fitted condenser tube with the hydrophobic coating. With coating by means of the sol gel method hydrophobic coatings are used which have a sol gel construction. Such sol gel-based hydrophobic coatings are based on hybrid polymers comprising a network structure having organic and inorganic components. Organically modified metal oxides, such as Si, Ti, Zr or Al alkoxides, can be used as the starting material for producing such sol gel coatings. Si alkoxides are preferably used as precursors and have the following chemical structure for example:

$$X_n\text{-Si—(OR)}_{4-n}$$

where:

X=organic modification of the alkoxide

R=alkyl group (for example methyl, ethyl) or aryl group (for example phenyl)

X (organic modification of the alkoxide) can be a reactive or non-reactive side chain. The coating is prepared by hydrolysis and condensation of the metal alkoxides. The organic modification of the metal oxide can affect the properties of the coating. The hydrophobic side chains X (for example alkyl chains, alkyl groups, fluorine alkyl chains, siloxane groups) reduce the surface energy of the coating and bring about a water-(hydrophobic) and oil-(oleophobic) repelling effect. The organic modification can have sufficient steam stability.

The described hydrophobic sol gel-based coating material can be modified further by the incorporation of surface-treated nanoscale or microscale particles, whereby the mechanical wear resistance or the corrosion resistance for example can be improved.

The hydrophobic sol gel coatings can be applied to the substrate (condenser tube) using the sol gel method, for example via wet chemical methods such as spraying, dipping, flooding, rolling or painting. The coatings are then thermally cured or crosslinked. The temperature ranges of the above-described crosslinking step can be used for example in this connection, although a curing temperature in temperature ranges from ambient temperature to 400° C. (Celsius) is also possible. A higher curing temperature above 400° can lead to a glassy layer, wherein the hydrophobic properties can be reduced. Short-chain side groups, such as X=methyl groups, aryl groups, also have sufficient thermal stability. A layer thickness in a range from 100 nm (nanometers) to 100 μm (micrometers) can also be achieved.

The hydrophobic coating on the fitted condenser tube can be applied by means of the sol gel method in such a way that, for example, the contact angle of the hydrophobic coating is 90° (degrees), 100° or 120°. Compared with untreated metal surfaces or tube surfaces of the condenser tubes, use of a hydrophobic coating with a contact angle between 90° and 130°, in particular between for example 100° and 120°, captures about 20% more condensate, whereby the condensation output of the condenser can be significantly improved.

According to a further exemplary embodiment the condenser is a steam condenser and the thermal power plant is a steam turbine plant.

According to a further exemplary embodiment of the present invention the device for coating a fitted condenser tube with the hydrophobic coating according to the above-described production method comprises a positioning mechanism for positioning the device relative to the carrier of the condenser tube bundle. The device also comprises a movement mechanism for moving the spray head along and/or transversely to a direction of extension of the condenser tube. The positioning mechanism can, for example, be an independent unit and be fixed relative to the carrier. On the other hand the positioning mechanism can be fastened to the carrier itself and mount the coating device. The device for coating the fitted condenser tube can be the spray mechanism, for example.

The coating device also comprises the spray head for coating the fitted condenser tube with the hydrophobic coating. The spray head can consist of a nozzle for example, which can apply the hydrophobic coating to a surface of the condenser tube in a fine spray. The movement mechanism can be movably connected to the positioning mechanism and be moved along a predefined linear direction of movement, so a uniform application of the hydrophobic coating to the condenser tubes can be provided by means of the spray head.

According to a further exemplary embodiment of the device the spray head is constructed in such a way that the hydrophobic coating can be applied to the fitted condenser tube by means of electro spray coating. By way of example, the spray head can be connected in this case to a voltage source and therefore electrostatically charge a spray of the hydrophobic coating.

According to a further exemplary embodiment the device for coating the fitted condenser tube comprises a connecting tube. The connecting tube can connect the movement mechanism and the spray head. The connecting tube has a helical shape in this case, wherein the lead of the helical shape can be adapted to a condenser tube radius and to condenser tube spacings of the condenser tubes in the condenser tube bundle. In other words, the helical shape of the connecting tube describes a helical line, similar to in the case of a corkscrew. On the one hand the lead of the helical shape can be permanently predefined to condenser tube radii and to the condenser tube spacings, and by rotating the spray head the connecting tube is screwed-in along the condenser tubes. The connecting tube can therefore be permanently adapted to the condenser tube radii and the condenser tube spacings as early as during its production. In a further embodiment the connecting tube can be produced from a resilient material or deformable material, such as rubber, so during rotation of the connecting tube into the condenser tube bundle the connecting tube adapts to the condenser tube radii and the condenser tube spacings and thus forms the helical shape. The adaptable connecting tube can provide a possibility for coating an existing condenser tube bundle comprising a large number of condenser tubes with a hydrophobic coating. Even inner condenser tubes of the condenser tube bundle can be coated with the hydrophobic coating therefore. It is therefore no longer necessary to dismantle the inner, and therefore hidden, condenser tubes from the condenser tube bundle in order to provide a hydrophobic coating of the condenser tubes.

According to a further exemplary embodiment the condenser is constructed as a heating condenser. A heating condenser can be taken to mean a condenser which is supplied with a relatively high steam pressure to thereby shift the condensation point of the steam into higher temperature ranges. The high steam pressure in the heating condenser can be generated for example by removing steam at high pressure and at a high temperature from a turbine stage of a thermal power plant and then feeding it to the heating condenser. The temperature difference (i.e. the temperature difference between primary and secondary return temperatures) of the heating condensers can be reduced using the proposed technical solution (i.e. their function is improved or restored), whereby a slightly higher temperature of the thermal transfer medium (fluid in the district heating network) can be achieved with the same heating steam parameters. On the other hand, a smaller heat exchanger area (reduction in costs and/or space) can be used with the same temperature difference, or the output of an existing heat exchanger can be increased.

According to a further exemplary embodiment the condenser is constructed as a high-pressure preheater or as a low-pressure preheater.

A low-pressure preheater can for example be arranged upstream of a feed water tank and the working fluid (for example water) be obtained in the condensed liquid state from what are known as condensate pumps. Pressurized steam can also be removed from the steam turbines and be fed to the low-pressure preheater. The temperature level of the working fluid is thereby increased in the low-pressure preheater and therewith in the adjoining feed water tank as well. This increase in temperature level increases the efficiency of the steam circuit in the thermal power plant. The new solution also achieves an improvement/restoring of the function and/or a reduction in costs and/or an increase in the output of the apparatus in this case.

A high-pressure preheater can be arranged between the feed water tank and the steam generator. As in the case of the low-pressure preheater, (highly) pressurized, hot steam is fed from the steam turbines to the high-pressure preheater. The energy level, in particular the temperature level, of the feed water entering the steam generator is therefore increased. The efficiency of the steam circuit can therefore be increased in the thermal power plant. Improvements in function, cost and/or output can be achieved in a manner similar to that in the case of the low-pressure preheater.

According to a further exemplary embodiment of the condenser, the condenser is used in the thermal power plant of a combined heat and power station. A combined heat and power station is used to generate electricity and heat using a power-heat coupling process. The heat diverted from the steam circuit in the combined heat and power station can be dissipated via the condenser (constructed as a heating condenser for example) or a different heat exchanger to a working fluid of a district heating circuit. The unused waste heat in a combined heat and power station comprising a power-heat coupling process can therefore be used further in a district heating system.

It is pointed out that embodiments of the invention have been described with reference to different objects of the invention. In particular some embodiments of the invention are described with device claims and other embodiments of the invention with method claims. However, on reading the application it will immediately be clear to a person skilled in the art that, unless explicitly disclosed otherwise, in addition to a combination of features which belong to one type of object of the invention, any desired combination of features which belong to different types of object of the invention is also possible.

BRIEF DESCRIPTION OF THE DRAWINGS

For the purpose of further explanation and for a better understanding of the present invention exemplary embodiments will be described in more detail hereinafter with reference to the accompanying drawings, in which.

DETAILED DESCRIPTION OF EXEMPLARY EMBODIMENTS

Figure 1:
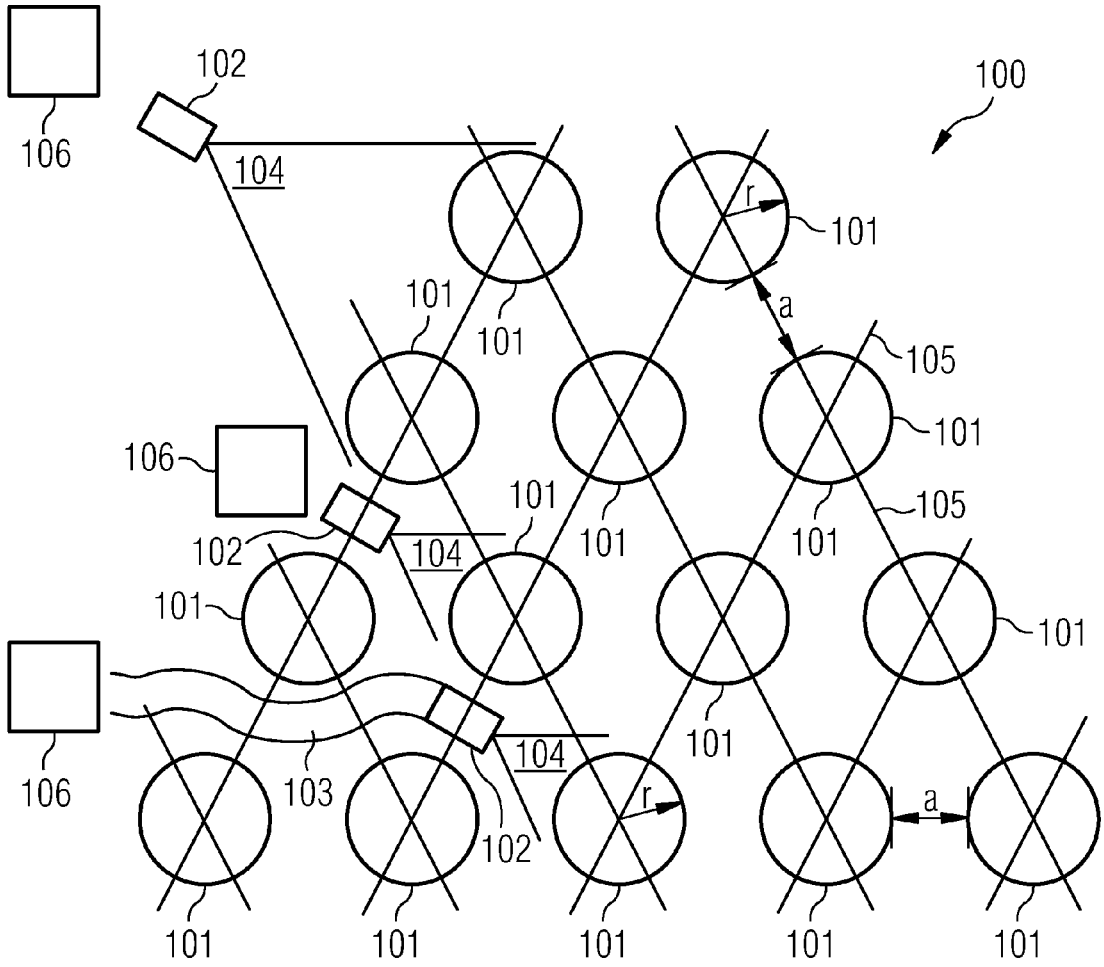
FIG. 1 shows a schematic diagram of a condenser tube bundle having a hydrophobic coating according to an exemplary embodiment of the present invention.

Identical or similar components are provided with the same reference characters in the figures. The diagrams in the figures are schematic and not to scale.

FIG. 1 shows an exemplary embodiment of a condenser 100, for example a steam condenser 100, for a thermal power plant, for example a steam turbine plant. The condenser 100 can be coated with a hydrophobic coating using the described production method. The condenser 100 has a carrier 105 in which fitted condenser tubes 101 are fastened. A fitted condenser tube 101 has a hydrophobic coating in this case.

According to the method for producing the condenser 100 for a steam turbine plant a condenser tube 101 is firstly fitted in the carrier 105 for a condenser tube bundle 203 of the condenser 100. The fitted condenser tube 101 is coated with a hydrophobic coating.

The carrier 105 can be used to mount and fasten each of the condenser tubes 101, so the condenser tube bundle 203 can be provided from a large number of fastened condenser tubes 101. The condenser tube bundle 203 comprises outer condenser tubes 101 and inner condenser tubes 101, which do not have any contact with the surroundings of the condenser tube bundle 203.

During operation of the condenser 100 the fitted condenser tubes 101 comprise a cooling fluid, for example cooling water, to provide condensation of the steam by cooling steam that flows past. The hydrophobic coating of the fitted condenser tubes 101 means that dropwise condensation of the steam that flows past also takes place.

According to the described production method a hydrophobic coating can be applied to the condenser tubes 101 by means of the spray mechanism 106. The condenser tubes 101 have already been fitted on the carrier 105 when the hydrophobic coating is applied, so time-intensive dismantling is no longer necessary for coating the condenser tubes 101. The situation where the hydrophobic coating of a condenser tube 101 is damaged as it is fitted is also avoided.

The spray mechanism 106 can, for example, comprise a spray head 102 with which a hydrophobic coating can be sprayed onto the condenser tubes 101. A defined atomizing cone 104 forms in the process. Spread coating, for example by means of brush devices, is also possible in addition to spraying the condenser tubes 101 by means of a spray head 102.

On the one hand the spray head 102 can be moved in the longitudinal direction (direction of extension) of the outer condenser tubes 101, so the hydrophobic coating can be applied to at least the outer condenser tubes 101. Furthermore, the spray head 102 of the spray mechanism 106 can be constructed to be so small that the spray head 102 can be inserted between a condenser tube spacing a. The spray mechanism 106 can thus at least also coat the second row of condenser tubes 101 in the condenser tube bundle 203 with a hydrophobic coating.

In a further exemplary embodiment the spray mechanism 106 can comprise a connecting tube 103, so all inner condenser tubes 101 of the condenser tube bundle 203 can also be coated with the hydrophobic coating in a fitted state. The connecting tube 103 can have a helical shape in this case (helical line), it being possible to select the lead of the helical line such that the lead adapts to the condenser tube radii r and the condenser tube spacings a. The spray head 102 can consequently be screwed into the condenser tube bundle 203 by rotating the connecting tube 103. Each inner condenser tube 101 can therefore be coated by means of the hydrophobic coating.

Figure 2:
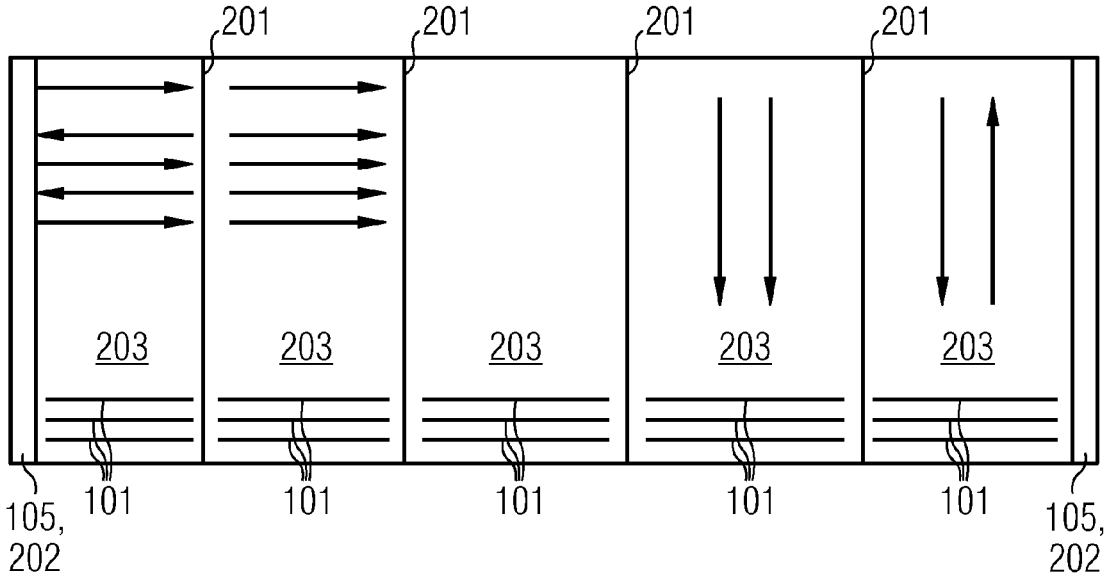
FIG. 2 shows a plan view of condenser tubes in a condenser tube bundle according to an exemplary embodiment of the present invention.

FIG. 2 illustrates a plan view of fitted condenser tubes 101 in the condenser tube bundle 203. The carrier 105 of the condenser tube bundle 203 comprises for example a condenser tube bottom 202 and a large number of supporting walls 201 to mount the condenser tubes 101. The hydrophobic coating can either be applied in the longitudinal direction or in the transverse direction of the condenser tubes. The spray mechanism 106 can apply the hydrophobic coating in the transverse direction or longitudinal direction of the condenser tubes 101 either in one direction or in alternating directions. The spray mechanism 106 can also be moved in the longitudinal direction or transverse direction of the condenser tubes 101. The spray mechanism 106 can for example move the spray head alternately in one direction, in the direction of extension of the condenser tubes 101 or in the transverse direction. A mixture of the two directions of movement (in the direction of extension and in the transverse direction) is also possible. The spray mechanism 106 can, for example, be moved along a positioning mechanism or a movement mechanism in this connection and during movement the spray head 102 can rotate transversely relative to the movement direction of the spray mechanism 106 or execute a pitch, making a mixture of two spray directions possible. This allows uninterrupted application of the hydrophobic coating.

Figure 3:
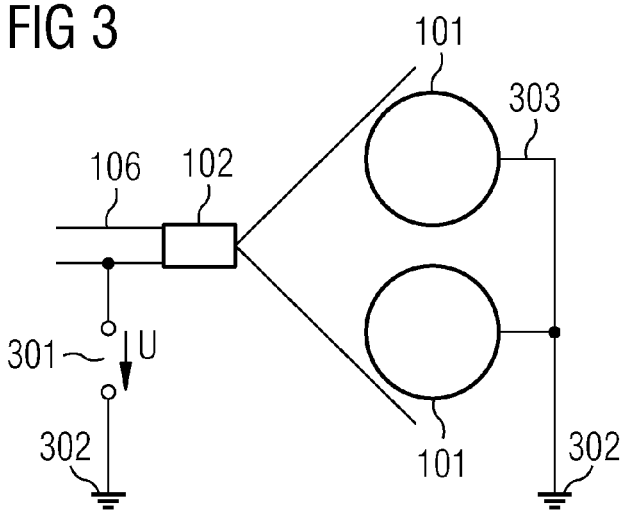
FIG. 3 shows an exemplary embodiment of condenser tubes which are treated by means of electrospray coating.

FIG. 3 shows an exemplary embodiment of a construction for applying the hydrophobic coating by means of electrospray coating. The condenser tubes 101 and/or the carrier 105 can be electrically conductive and thus constitute electrically conductive structural components 303. The electrically conductive structural components 303 can be connected to a ground potential 302. The spray mechanism 106 and/or the spray head 102 are connected to a voltage source 301, so the spray of the hydrophobic coating can be electrostatically charged, for example at 30 kV, 40 kV, 50 kV or 60 kV (kilovolts). The electrostatically charged spray of the hydrophobic coating is attracted owing to the grounded condenser tubes 101, so the spray is uniformly applied to the condenser tubes 101. A fitted condenser tube 101 can be comprehensively sprayed with the hydrophobic coating as a result of the attraction of the electrostatically charged spray of the hydrophobic coating. Even if the spray head 102 applies the spray to one side of the condenser tube, the spray can be attracted to the opposing side of the condenser tube 101 owing to the electrostatic attraction, so the hydrophobic coating is applied to the opposing side. A uniform application of the hydrophobic coating can therefore be provided in the fitted state even in the case of condenser tubes 101 that are difficult to reach.

The present invention can therefore provide a condenser tube bundle 203 for a condenser 100 which comprises fitted and hydrophobically coated condenser tubes 101. Coating the condenser tubes 101 in the fitted state means that the production process for the condenser tube bundle 203 can be accelerated as the coating process does not have to be carried out individually for each condenser tube 101. Instead it only needs to be carried out once for all of the fitted condenser tubes 101. Furthermore, a coating of the condenser tubes 101 can be provided during maintenance of a condenser 100 already mounted on the steam turbine plant and operating, without the condenser tubes 101 having to be dismantled. Damage to the hydrophobic coating, which occurs when fitting a condenser tube 101 into the carrier 105 of the condenser tube bundle 203, can similarly be avoided as the condenser tubes 101 are only coated with the hydrophobic coating after they have been fitted in the carrier 105 of the condenser tube bundle 203.

By way of addition it should be pointed out that "comprising" does not exclude other elements or steps and "one" or "a" does not exclude a large number. It should also be pointed out that features or steps which have been described with reference to one of the above exemplary embodiments can also be used in combination with other features or steps of other above-described exemplary embodiments. Reference characters in the claims should not be regarded as limitations.

The invention claimed is:

1. A method for producing a condenser, the production method comprising:

fitting a condenser tube in a carrier of a condenser tube bundle of the condenser; and coating the fitted condenser tube with a hydrophobic coating, the coating comprises:

positioning a spray mechanism on the carrier, spraying the hydrophobic coating using the spray mechanism, and moving the spray mechanism during spraying at a uniform feed rate along a direction of extension of the fitted condenser tube.

2. The method as claimed in claim 1, wherein the condenser is produced for a thermal power plant.

3. The method as claimed in claim 2, wherein the condenser is mounted on the thermal power plant during coating.

4. The method as claimed in claim 2, wherein the condenser is a steam condenser and the thermal power plant is a steam turbine plant.

5. The method as claimed in claim 1, wherein in an additional step, the fitted condenser tube is further coated with the hydrophobic coating using a spread coating.

6. The method as claimed in claim 1, wherein the spray mechanism comprises a spray head.

7. The method as claimed in claim 6, wherein the coating of the fitted condenser tube with the hydrophobic coating further comprises, introducing the spray head into the carrier to coat the fitted condenser tube with the hydrophobic coating.

8. The method as claimed in claim 1, wherein the coating of the fitted condenser tube with the hydrophobic coating comprises, using electrospray coating to coat the fitted condenser tube.

9. The method as claimed in claim 1, further comprising:

crosslinking the hydrophobic coating on the fitted condenser tube using UV curing, dual cure and/or thermal curing.

10. The method as claimed in claim 1, wherein the hydrophobic coating has a sol gel construction.

11. The method as claimed in claim 1, wherein the spray mechanism applies the hydrophobic coating in a longitudinal direction or in a transverse direction of a plurality of condenser tubes, and wherein the spray mechanism applies the hydrophobic coating in one direction or in alternating directions.

* * * * *